US005751828A

United States Patent [19]

Ueda et al.

[11] Patent Number: 5,751,828

[45] Date of Patent: May 12, 1998

[54] MAGNETIC CIRCUIT UNIT FOR LOUD-SPEAKER AND METHOD OF MANUFACTURING THE SAME

[75] Inventors: Hiroshi Ueda, Hyogo; Kazuhiro Ohyama; Shizuo Furuyama, both of Osaka; Kiyoshi Kojima, Nara; Masayuki Wakamiya, Osaka, all of Japan

[73] Assignee: Matsushita Electric Industrial Co., Ltd., Osaka, Japan

[21] Appl. No.: 451,653

[22] Filed: May 26, 1995

[30] Foreign Application Priority Data

May 30, 1994 [JP] Japan ..... 6-116455
Dec. 27, 1994 [JP] Japan ..... 6-324752

[51] Int. Cl.[6] ..... H04R 25/00

[52] U.S. Cl. ..... 381/199; 381/201; 29/594

[58] Field of Search ..... 381/192, 194, 381/199, 201; 310/13; 335/222, 302, 306; 29/594, 609.1; 148/302

[56] References Cited

U.S. PATENT DOCUMENTS

| | | | |
|---|---|---|---|
| 2,698,917 | 1/1955 | Van Urk et al. | 381/201 |
| 4,386,332 | 5/1983 | Saito | 335/231 |
| 5,086,967 | 2/1992 | Delalle et al. | 228/56.3 |
| 5,100,485 | 3/1992 | Yamashita et al. | 148/101 |
| 5,154,978 | 10/1992 | Nakayama et al. | 428/469 |
| 5,201,962 | 4/1993 | Yamashita et al. | 148/101 |
| 5,229,461 | 7/1993 | Saitoh et al. | 525/200 |
| 5,402,503 | 3/1995 | Prokisch | 381/199 |
| 5,446,797 | 8/1995 | Paddock | 381/199 |

FOREIGN PATENT DOCUMENTS

| | | |
|---|---|---|
| 63-99700 | 4/1988 | Japan . |
| 2-4100 | 1/1990 | Japan . |
| 4-255201 | 9/1992 | Japan . |
| 5-302197 | 11/1993 | Japan . |
| 2106353 | 4/1983 | United Kingdom . |

OTHER PUBLICATIONS

"New Method of Making Nd–Fe–Co–B Full Dense Magnet", IEEE Transactions on Magnetics, vol. 26, No. 5, Sep. 1990, pp. 2601–2603.

*Primary Examiner*—Huyen Le
*Attorney, Agent, or Firm*—Merchant, Gould, Smith, Edell, Welter & Schmidt, P.A.

[57] ABSTRACT

A magnetic circuit unit for a loud-speaker is provided, in which an adhesion step can be reduced or omitted, magnetic properties can be improved through enhancement of magnetic efficiency, and a durable anti-corrosive treatment can be performed at low price, so that higher performance and lower cost of the loud-speaker can be attained. A method of manufacturing the same is also provided. A top plate has a conical, columnar, truncated conical, or partially spherical hollow part formed on one side whose inner surface is integrated with an anisotropic Nd—Fe—B system magnet under a forming pressure of 100 to 200 kgf/cm$^2$ through Joule heating by passing a current under compression. The forming die is cooled to a temperature below 100° C. while maintaining the pressure, and the compact is then taken out from the forming die. This integrated compact is adhered to an outer yoke, and a looped yoke and a loop anisotropic Nd—Fe—B system magnet are also adhered thereon to fabricate a magnetic circuit unit. Subsequently, this magnet circuit unit is dipped in acrylic resin emulsion, and a coating of 7 to 15 μm thick is formed by using a rotary coating device.

16 Claims, 9 Drawing Sheets

MAGNETIC CIRCUIT UNIT FOR LOUD-SPEAKER AND METHOD OF MANUFACTURING THE SAME

FIELD OF THE INVENTION

This invention relates to a magnetic circuit unit and a method of manufacturing the same. In particular, this invention relates to a magnetic circuit unit for a loud-speaker.

BACKGROUND OF THE INVENTION

A configuration of a conventional magnetic circuit unit for a loud-speaker is shown in FIG. 9. This magnetic circuit unit for a loud-speaker comprises a top plate 2, a sintered magnet 7, and an outer yoke 3. The sintered magnet 7 is magnetized in an axial direction, and its magnetic flux is made to concentrate toward a magnetic pole gap 8 by the top plate 2. This type of loud-speaker is used for a thin portable radio, or in the field of movable communication for a portable telephone etc., and the demand for this loud-speaker is increasing rapidly. In order to attain a loud-speaker which is small, light-weight, and thin, rare earth magnets are used as a magnet in a loud-speaker, and among these magnets, an anisotropic neodymium (Nd)-iron(Fe)-boron(B) system sintered magnet is widely used in view of performance and cost.

However, since the anisotropic Nd—Fe—B system sintered magnet is expensive, an experiment of using a lower amount of magnet material by sandwiching a magnet material with soft magnetic materials having high saturation magnetization has been conducted (e.g., Laid-open Japanese patent application No. (Tokkai Hei) 4-255201). On the other hand, not much has been done to improve performance and to reduce cost of a magnetic circuit unit from the viewpoint of its structure and fabrication. Furthermore, another experiment has been performed to make a thinner unit by integrating a ring-shaped sintered magnet of which magnetic moments are radially aligned with a yoke through sintering (e.g., Laid-open Japanese patent application No. (Tokkai Sho) 63-99700).

In addition, since a Nd—Fe—B system magnet is apt to rust easily, it is indispensable to apply an anti-corrosive treatment, and various treating methods have been proposed. For example, cation electrodeposition is an excellent anti-corrosive treatment, but the problem with this method is that the equipment cost for temperature control is extremely high. A wet anti-corrosive treated film is also proposed, but there was no method which can accomplish a uniformly formed coat with satisfaction in a complicated magnetic circuit unit.

Furthermore, it is common in the manufacturing process of a loud-speaker to bond a magnet and yoke materials comprising a magnetic circuit unit together by means of an adhesive.

Also, it was strongly desired in a small magnetic circuit unit such as the loud-speaker mentioned above to omit an adhesion step for improving the accuracy in the magnetic pole gap and for eradication of adhesion failures. This would also contribute greatly to reduction of the cost.

Also, there was a problem in the process of manufacturing a thinner magnetic circuit unit, namely, when a top plate is formed thinner than a magnet thickness, width of a uniform magnetic field in a magnetic pole gap decreases, which results in deterioration of tone quality of a loud-speaker. In addition to this problem, magnetic flux density in the magnetic pole gap was reduced due to an increase of leakage flux from an upper surface of the top plate, so that measures to overcome these problems were strongly desired.

Furthermore, as for an anti-corrosive treatment of a Nd—Fe—B system magnet, a method of forming a uniform anti-corrosive film with excellent cost performance was pursued.

SUMMARY OF THE INVENTION

It is an object of this invention to solve the above-mentioned problems in the conventional system by providing a magnetic circuit unit for a loud-speaker, in which an adhesion step can be reduced or omitted, magnetic properties can be improved through enhancement of magnetic efficiency, and a durable anti-corrosive treatment can be performed at low price, so that higher performance and lower cost for the loud-speaker can be attained. Another object of this invention is to provide a method of manufacturing the same.

In order to accomplish these and other objects and advantages, a first magnetic circuit unit for a loud-speaker of this invention comprises a top plate which is integrated with an anisotropic Nd—Fe—B system magnet on one side of the top plate, wherein the top plate has a hollow part whose inner surface is bonded to the anisotropic Nd—Fe—B system magnet through Joule heating by passing a current under compression, and an anti-corrosive coating is formed on the surface of the unit.

It is preferable in the above-mentioned configuration that the hollow part of the top plate is formed in the shapes of cone, column, truncated cone, or partial sphere.

Furthermore, it is preferable in the above-mentioned configuration that the anti-corrosive coating comprises an acrylic resin anti-corrosive coating with a thickness of 7 to 15 μm.

Next, a second magnetic circuit unit for a loud-speaker of this invention comprises a top plate which is integrated with an anisotropic Nd—Fe—B system magnet on one side of the top plate, wherein the top plate has a hollow part whose inner surface is bonded to the anisotropic Nd—Fe—B system magnet through Joule heating by passing a current under compression, and a magnetic circuit unit which is bonded with a loop anisotropic Nd—Fe—B system magnet at a looped yoke is disposed at the outer circumference of the unit, and an anti-corrosive coating is formed on the surface of the unit.

It is preferable in the above-mentioned second configuration, in which a magnetic circuit unit is provided with a magnetic circuit bonded with a loop anisotropic Nd—Fe—B magnet at a looped yoke in the outer circumference, that the hollow part of the top plate is formed in the shapes of cone, column, truncated cone, or partial sphere.

Furthermore, it is preferable in the above-mentioned second configuration that the anti-corrosive coating comprises an acrylic resin anti-corrosive coating with a thickness of 7 to 15 μm.

In addition, it is preferable that a loud-speaker comprises a magnetic circuit unit of the above-mentioned first and second configurations.

Next, a method of manufacturing a magnetic circuit unit for a loud-speaker of this invention comprising a top plate which is integrated with an anisotropic Nd—Fe—B system magnet on one side of the top plate, comprises the steps of magnetically orienting the top plate disposed with a hollow part and anisotropic Nd—Fe—B system magnet powder inside a forming die, integrated bonding through Joule heating by passing a current under compression, adhering the integrated compact to an outer yoke, adhering a loop anisotropic Nd—Fe—B system magnet to a looped yoke, and forming an anti-corrosive coating thereon.

It is preferable in the above-mentioned configuration that the step of integrated bonding through Joule heating by passing a current under compression is performed under a forming pressure of 100 to 200 kgf/cm$^2$.

Furthermore, it is preferable in the above-mentioned configuration that after the step of integrated bonding through Joule heating is completed, the forming die is cooled to a temperature below 100° C. while maintaining the pressure, and the integrated compact is then taken out from the forming die.

In addition, it is preferable in the above-mentioned configuration that a method of forming the anti-corrosive coating comprises the steps of dipping in an acrylic resin emulsion, coating by means of a rotary coating device, and drying and hardening to form a coating with a thickness of 7 to 15 μm.

Also, it is preferable in the above-mentioned configuration that steps comprising adhering a loop anisotropic magnet to a looped yoke and adhering the loop anisotropic magnet to the outer yoke are performed after the step of adhering the integrated compact to an outer yoke and before the step of forming an anti-corrosive coating thereon.

According to the above-mentioned configuration of this invention, the inner surface of the hollow part in the top plate and the anisotropic Nd—Fe—B system magnet are bonded integrally through Joule heating by passing a current under compression, and the surface is covered with an anti-corrosive coating, so that an adhesion step can be reduced or omitted, magnetic flux density can be improved without reducing a width of uniform magnetic field in a magnetic pole gap, and a durable anti-corrosive treatment can be performed at low price, thereby attaining higher performance and lower cost for the loud-speaker.

In the above-mentioned magnetic circuit unit for a loud-speaker, forming the hollow part into the shapes of cone, column, truncated cone, and partial sphere assures the bonding between the top plate and the anisotropic Nd—Fe—B system magnet. In addition, magnetic flux density can be improved without reducing a width of uniform magnetic field in a magnetic pole gap, so that a magnetic circuit unit for a loud-speaker can be obtained, which has a smaller size, higher performance and reduced cost.

The preferable configuration in that the anti-corrosive coating comprises an acrylic resin anti-corrosive coating with a thickness of 7 to 15 μm enables the carrying out of a durable anti-corrosive treatment at low price, improving performance, and reducing the cost of a loud-speaker.

Next, according to the above-mentioned configuration of this invention, the inner surface of the hollow part in the top plate and the anisotropic Nd—Fe—B system magnet are bonded through Joule heating by passing a current under compression, the magnetic circuit which is bonded to a loop anisotropic Nd—Fe—B system magnet at a looped yoke is disposed in the circumference, and an anti-corrosive coating is formed on the surface. As a result, the adhesion step can be reduced or omitted, deterioration of magnetic properties due to thinner formation can be improved, and a durable anti-corrosive treatment can be performed at low price, thereby attaining a magnetic circuit unit for a loud-speaker which enables a thinner form, higher performance, and lower cost for a loud-speaker.

In the above-mentioned configuration of a magnetic circuit unit for a loud-speaker, wherein the top plate has a hollow part whose inner surface is bonded to the anisotropic Nd—Fe—B system magnet through Joule heating by passing a current under compression, and a magnetic circuit which is bonded with a loop anisotropic Nd—Fe—B system magnet at a looped yoke is disposed in the outer circumference, forming the hollow part into the shapes of cone, column, truncated cone, and partial sphere assures the bonding between the top plate and the anisotropic Nd—Fe—B system magnet, and magnetic flux density can be improved without reducing a width of uniform magnetic field in a magnetic pole gap. In this way, a magnetic circuit unit for a loud-speaker can be obtained which enables a smaller size, higher performance and reduced cost for a loud-speaker.

The manufacturing method of this invention comprises the steps of magnetically orienting the top plate disposed with a hollow part and anisotropic Nd—Fe—B system magnet powder inside a forming die, integrated bonding through Joule heating, and forming an anti-corrosive coating thereon. Thus, the adhesion step can be reduced or omitted, and as a result, the equipment cost and the manufacturing cost can be reduced. In addition, magnetic efficiency can be enhanced, so a magnetic circuit unit for a loud-speaker which has improved magnetic performance and anti-corrosive property can be attained.

Determining the formation pressure in the process of integrated bonding through Joule heating to be 100 to 200 kgf/cm$^2$ enables even stronger bonding.

As mentioned above, after the step of integrated bonding through Joule heating by passing a current under compression is completed, the forming die is cooled to a temperature below 100° C. while maintaining the pressure, and the compact is then taken out from the forming die. In this way, the bonding can be stabilized, and occurrence of cracks etc. can be prevented.

The preferable method of forming an anti-corrosive coating comprises the steps of dipping in an acrylic resin emulsion, coating by means of a rotary coating device, and drying and hardening to form a coating with a thickness of 7 to 15 μm. As a result, anti-corrosive coatings can be produced efficiently, so the equipment cost can be reduced.

DETAILED DESCRIPTION OF THE INVENTION

This invention will be described in detail by referring to the following illustrative examples and attached figures. The examples are not intended to limit the invention in any way.

A magnetic circuit unit for a loud-speaker of this invention is comprised of a Nd—Fe—B system magnet which is formed through Joule heating by passing a current under compression, a top plate having a hollow part which is integrated with this magnet, and an outer yoke or a looped yoke. In this embodiment, the top plate comprises a material with high permeability such as an electromagnetic steel plate or a silicon steel plate. An anisotropic Nd—Fe—B system magnet is used as the magnet which is formed through Joule heating by passing a current under compression. Examples of the above-mentioned acrylic emulsion resin include emulsions containing a resin whose monomer is selected from the group consisting of methacrylate ester, ester acrylate, methacrylic acid, acrylic acid, or derivatives etc. thereof. Styrene and butadiene etc. may be contained in this resin, and those containing a cross-linking initiator are used.

The top plate and the magnet are integrated by directly bonding the anisotropic Nd—Fe—B system magnet and the top plate disposed with a hollow part through Joule heating. Subsequently, a uniform anti-corrosive coating is formed with acrylic emulsion resin. The anti-corrosive coating comprising acrylic emulsion resin is formed by a curing reaction after coating. This anti-corrosive coating itself of acrylic emulsion resin is generally well known. A magnetic circuit unit obtained in this way allows the reduction or omission of an adhesion step, and magnetic properties are improved due to enhancement of magnetic efficiency, and furthermore, the anti-corrosive treatment is inexpensive and perfect, which contributes to higher performance and lower cost for the loud-speaker.

A method of forming through Joule heating used in this invention is a method which is already developed as a manufacturing method of a Nd—Fe—B system magnet (M. Wada and Yamashita: New method of making Nd—Fe—B full dense magnets. IEEE. Trans. Magn. MAG-26, No. 5, p.2601 (1990)). This method will be explained now more in detail.

This method comprises the steps of processing magnet powder as such through direct discharge inside a forming die cavity for activation, compressing through pressure, raising the temperature rapidly through Joule heating by passing a current and allowing plastic deformation to take place by pressure, and attaining a complete bulk of the magnet powder when atoms are bonded by dispersion at their interfaces.

Figure 8:
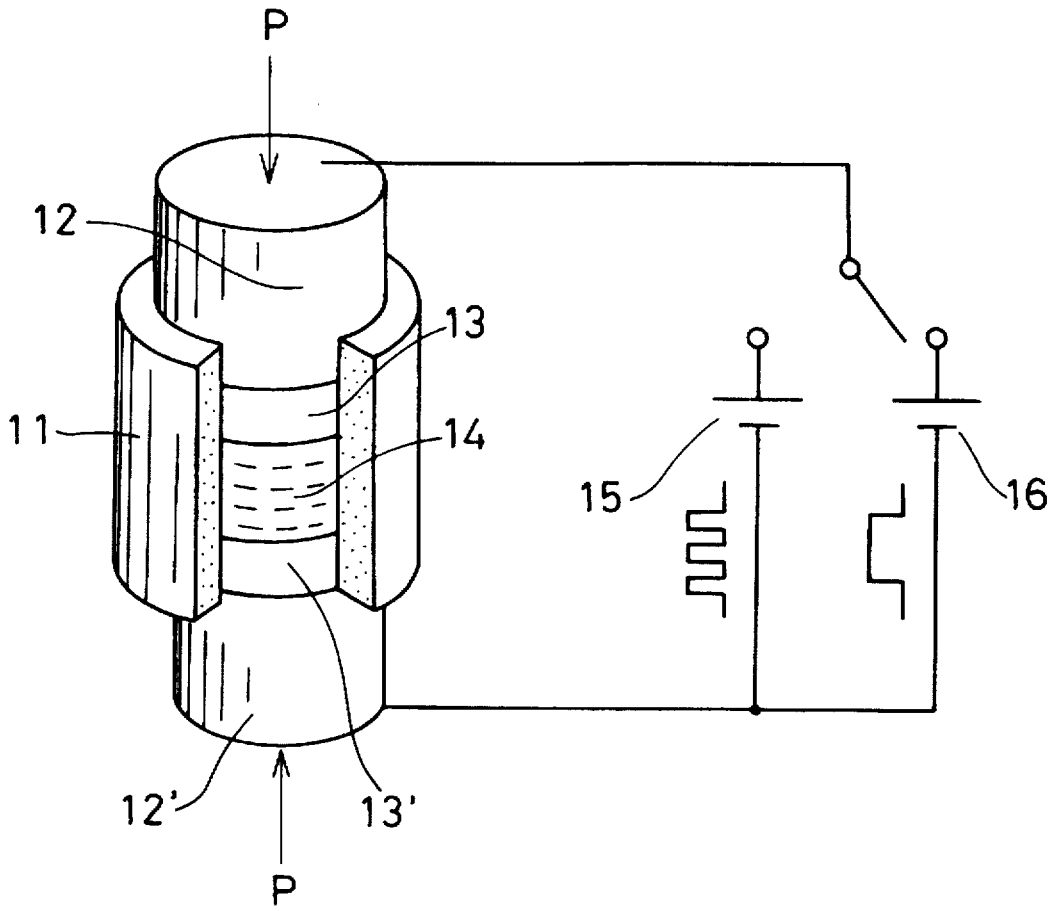
FIG. 8 is a partial cross-sectional view schematically showing a method of bonding through Joule heating by passing a current under compression.
Figure 9:
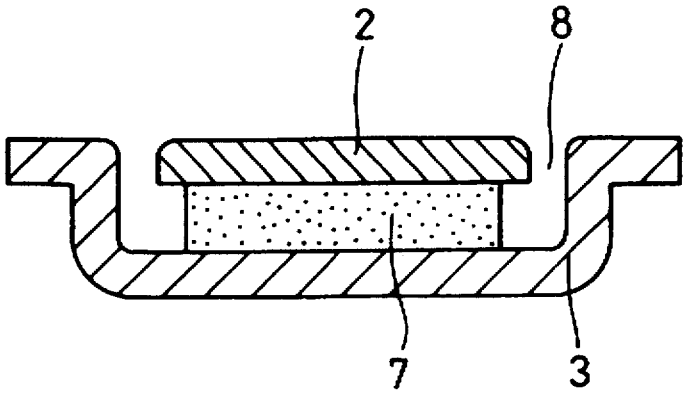
FIG. 9 (PRIOR ART)
FIG. 9 is a cross-sectional view showing a conventional magnetic circuit unit for a loud-speaker.

A structure of the main part is shown in FIG. 8. A die 11 was made of non-conductive ceramics, and Syalon (Si—Al—O—N system) was mainly used. Electrodes 12, 12' comprising graphite mounted with WCCo at edge parts 13, 13' serve also as punch. A space which exists between the die 11 and the electrodes 12, 12' comprised a cavity, and magnet powder 14 was filled into the cavity. The upper and lower electrodes 12, 12' were provided with pressure from pressure rods P, P', and via these pressure rods P, P', the electrodes 12, 12' were connected to a discharge processing source 15 and a Joule heating source 16 which can be switched. The die 11 and the electrodes 12, 12' are stored inside a vacuum chamber, and the inside of the cavity can be vacuumed.

According to the manufacturing method through Joule heating, first, magnet powder is filled into the cavity, and the atmosphere is vacuumed to $10^{-1}$ to $10^{-3}$ torr, and then, necessary compression pressure is provided between the electrodes 12, 12'. Subsequently, a DC pulse current is passed between the electrodes 12, 12' in this state to perform discharge processing (for example, for about 40 seconds), and then by providing a DC constant current (e.g., electric current density 300 A/cm$^2$), the temperature was raised rapidly through Joule heating. During this heating process, plastic deformation took place by pressure until the powder became a bulk and the deformation process is completed. At this moment, the current is stopped, and upon cooling to around the room temperature, the bulk magnet is taken out from the die.

In this invention, this method was applied to form a magnet for a loud-speaker, so in this case, the magnet powder and the top plate were placed simultaneously into the cavity to integrate the top plate and the magnet.

EXAMPLE 1

Figure 1:
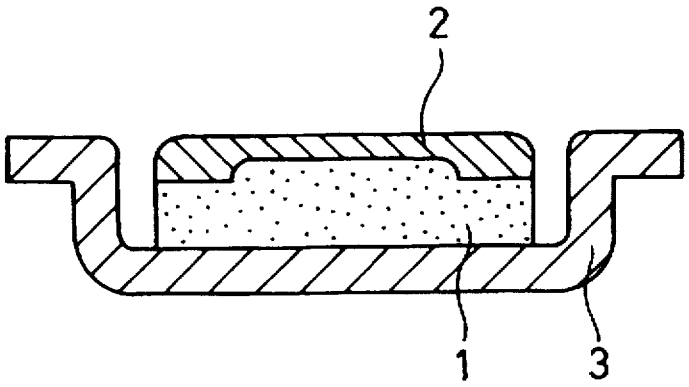
FIG. 1 is a cross-sectional view showing an integrated magnetic circuit unit in a first embodiment of this invention.

FIG. 1 is a cross-sectional view showing an integrated magnetic circuit unit in a first embodiment. In FIG. 1, reference numeral 1 represents a magnet which is formed through Joule heating by passing a current under compression; 2 represents a top plate; and 3 represents an outer yoke. An anisotropic Nd—Fe—B system magnet is used as the magnet 1 which is formed through Joule heating, and this magnet 1 is bonded to an inner surface of a hollow part formed on one side of the top plate 2 through Joule heating by passing a current under compression, thereby integrating the two parts. It is preferable to respectively determine a thickness of the top plate 2 to be from 0.3 to 0.8 mm and a diameter to be from 8 to 13 mm.

Next, shapes of the hollow part in the top plate 2 will be explained by referring to the figures.

Figure 2:
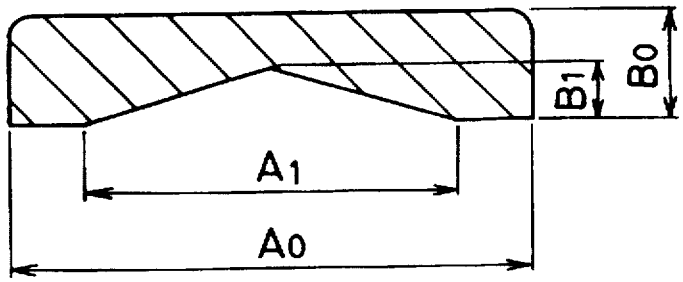
FIG. 2 is a cross-sectional view showing a top plate having a conical hollow part which is useful in this invention.

FIG. 2 is a cross-sectional view showing an example of the top plate 2 having a conical hollow part. In FIG. 2, it is preferable to respectively determine the dimension of a hollow part $A_1$ to be from 0.8 $A_0$ to $A_0$ and a dimension of $B_1$ to be from 0.4 $B_0$ to 0.5 $B_0$. This shape of the hollow part is characterized in that the thickness in the central part of the magnet is thicker than in an example in which a columnar magn et is integrate d with a top plate without a hollow part. As a result of that, magnetic permeance in this particular part increases, and therefore, thermal demagnetization can be reduced.

Figure 3:
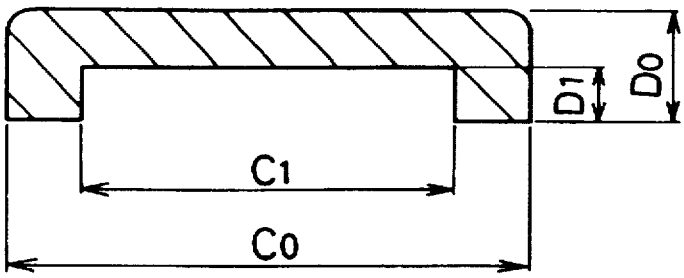
FIG. 3 is a cross-sectional view showing a top plate having a columnar hollow part which is useful in this invention.

FIG. 3 is a cross-sectional view showing an example of the top plate 2 having a columnar hollow part. In FIG. 3, it is preferable to respectively determine a dimension of a hollow part $C_1$ to be from 0.8 $C_0$ to 0.9 $C_0$ and a dimension of $D_1$ to be from 0.4 $D_0$ to 0.5 $D_0$. This shape of the hollow part is characterized in that this shape can attain an utmost magnet volume without reducing a surface area on the side of the top plate 2. In general, when a surface area on the side of a top plate is reduced, a maximum value of magnetic flux density in a magnetic pole gap improves, but the tone quality as a loud-speaker deteriorates due to a reduction of a width of uniform magnetic field. As a result, this embodiment enables the improvement of magnetic flux density in a magnetic pole gap by about 10% as compared with an example using a top plate without a hollow part.

Figure 4:
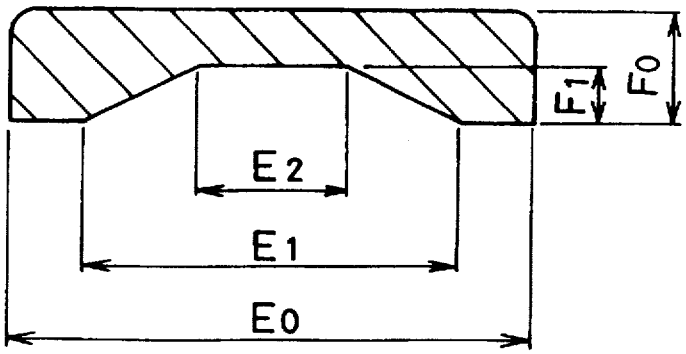
FIG. 4 is a cross-sectional view showing a top plate having a truncated conical hollow part which is useful in this invention.

FIG. 4 is a cross-sectional view showing an example of the top plate 2 having a truncated conical hollow part. In FIG. 4, it is preferable to respectively determine a dimension of a hollow part $E_1$ to be from 0.8 $E_0$ to 0.9 $E_0$, a dimension of $E_2$ to be from 0.4 $E_0$ to 0.5 $E_0$, and a dimension of $F_1$ to be from 0.4 $F_0$ to 0.5 $F_0$. This shape is characterized by combining a taper with a flat surface part, so that a punch used for processing the hollow part of the top plate can be removed easily from workpiece, which results in a long life-time of punch. It goes without saying that the magnetic properties are of the same level as that in other shapes.

Figure 5:
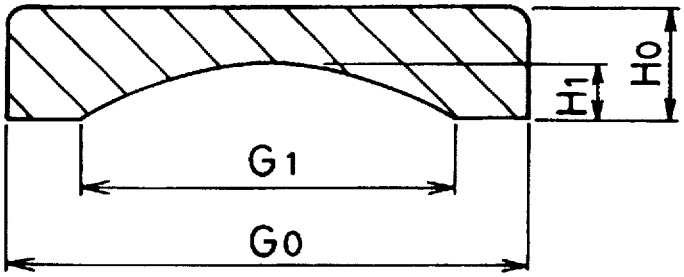
FIG. 5 is a cross-sectional view showing a top plate having a partially spherical hollow part which is useful in this invention.

FIG. 5 is a cross-sectional view showing an example of the top plate 2 having a partially spherical hollow part. In FIG. 5, it is preferable to determine a dimension of a hollow part $G_1$ to be from 0.8 $G_0$ to $G_0$ and a dimension of $H_1$ to be from 0.4 $H_0$ to 0.5 $H_0$. This shape is characterized by its spherical surface, which enables the easy removal of a punch and easy processing. It goes without saying that the magnetic properties are of the same level as that in other shapes.

Next, a method of manufacturing a magnetic circuit unit in this embodiment will be explained.

A top plate was placed inside a forming die used for Joule heating by passing a current under compression, and anisotropic neodymium-iron-boron system magnet powder was put into the same forming die. This magnet powder was manufactured by upsetting a hot-forming body made of melt spun powder of Nd—Fe—B system alloy and then powdering by means of a hydrogen decrepitation method. The magnet powder comprised particles having an average size of 150 μm.

Then, after the powder was pressed lightly while orienting in a vertical magnetic field, Joule heating by passing a current was conducted. The Joule heating was performed in an inactive gas while providing a pressure of 150 kgf/cm$^2$. The temperature of the forming die at this moment is preferably from 700 to 750° C. Electric power to pass a current is preferably about 15 V and 250 A.

When the Joule heating was completed, the forming die was cooled to 80° C. while maintaining the pressure, and the compact was then taken out from the forming die.

Subsequently, the compact was cooled to room temperature in dry air containing a volatile corrosion inhibitor with 0.4 to 0.7 ppm concentration (e.g., the product of the firm KYOEISHA KAGAKU CO., LTD. under the trade name of "RASMIN V-7". In this way, the neodymium-iron-boron system magnet which was bonded and integrated with the top plate was manufactured.

An integrated product, comprising a disk-form magnet, for example, having a diameter of 13 mm and a thickness of 1.3 mm bonded integrally with a top plate of 13 mm in diameter and 0.8 mm thick, was manufactured according to the above-mentioned method and an outer yoke was adhered thereto to form a magnetic circuit unit.

Figure 6:
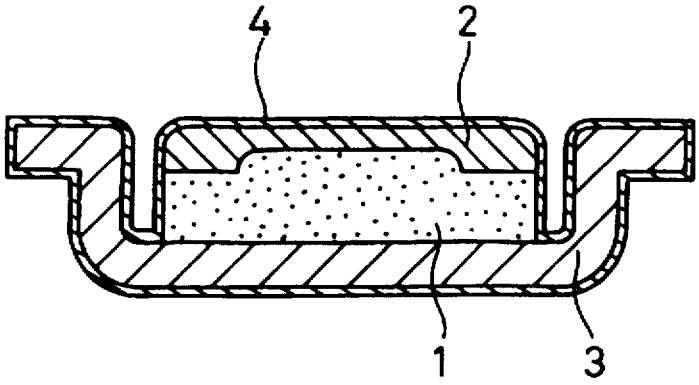
FIG. 6 is a cross-sectional view showing an integrated magnetic circuit unit covered with an anti-corrosive coating in a first embodiment of this invention.

Furthermore, after this magnetic circuit unit was dipped in an acrylic emulsion (containing a starting agent) comprising styrene -ester acrylate- methacrylic acid (the product of the firm NIHON SHOKUBAI CO., LTD. under the trade name "PJ-50"), a uniform coating was formed by using a centrifugal dehydrator, which is a kind of rotary coating device, with a peripheral speed of 1.0 to 1.3 m/s. The coating was dried and then hardened to form an anti-corrosive resin coating 4 (FIG. 6) having a thickness of 10 μm.

A loud-speaker was built by using the above-mentioned magnetic circuit unit, and after being pulse-magnetized, it was confirmed that the loud-speaker had a desired sound pressure and frequency characteristics. For example, the sound pressure was 84 dB. Furthermore, in this magnetic circuit unit, the top plate and the magnet were firmly bonded together, so no damage was sustained in a dropping test.

At the bonded part of the top plate with the magnet formed through Joule heating, the magnet powder contacting an electromagnetic steel plate of the top plate was pressed under compression, and in this state, a large current was passed into this contact part. Since contact resistance is large, Joule heat is generated rapidly to heat up this contact part to a high temperature, so that it is anticipated that a strong bonding is accomplished by atoms dispersing in the magnet powder and in the electromagnetic steel plate. Nd—Fe—B system magnet powder is softened at a temperature higher than about 600° C., so that deformation takes place under the compression pressure to increase a contact part with the electromagnetic steel plate. The magnet powder is molded together along a hollow part of the top plate without a gap, and atomic dispersion occurring at the bonded part of the magnet powder attains a strong bonding, thereby forming a bulk magnet. An adhesive layer is not present between the top plate and the magnet formed by Joule heating, and they are directly bonded to each other. As a result, magnetic resistance of a conventional adhesive layer does not interfere with a flow of magnetic flux, which results in an increase of magnetic flux density in the magnetic pole gap.

Due to the effects of a uniform anti-corrosive coating, no rust was found in a humidity test, in which the loud-speaker was left under the conditions of 60° C. and 95% RH for 500 hours.

Comparative Example 1

A magnetic circuit unit was manufactured according to the same method described in Example 1 except for using a top plate which does not have a hollow part on one side, and an anti-corrosive coating was formed. When this magnetic circuit unit was valued as a loud-speaker, it became clear that this comparative example had 0.5 dB lower sound pressure than that of Example 1.

Comparative Example 2

A magnetic circuit unit was manufactured according to the same method described in Example 1 except for using a temperature exceeding 100° C. for cooling a forming die while maintaining the pressure. As a result, cracks were formed on a face bonding the top plate and the magnet.

Comparative Example 3

A magnetic circuit unit was manufactured according to the same method described in Example 1 except for determining the forming pressure during Joule heating by passing a current to be below 100 kgf/cm$^2$ and exceeding 200 kgf/cm$^2$. As a result, when the forming pressure was below 100 kgf/cm$^2$, the top plate and the magnet were not bonded satisfactorily, and when the forming pressure exceeded 200 kgf/cm$^2$, the coercive force of the magnet deteriorated by 15% in comparison to Example 1.

EXAMPLE 2

A second embodiment of this invention will be explained by referring to FIG. 7.

Figure 7:
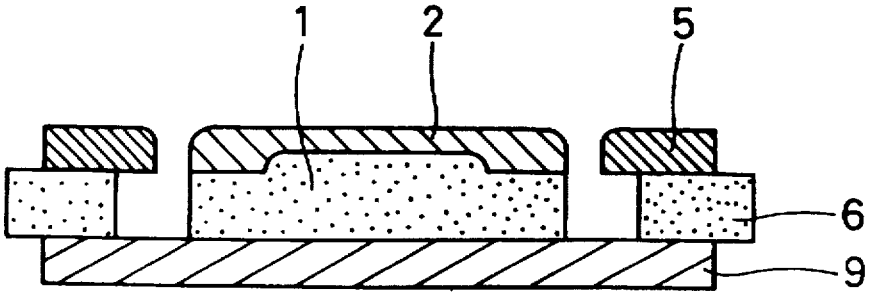
FIG. 7 is a cross-sectional view showing a magnetic circuit unit in a second embodiment of this invention.

FIG. 7 is a cross-sectional view showing a main part of a magnetic circuit unit in a second embodiment. In FIG. 7, 1 represents a magnet which is formed through Joule heating by passing a current under compression; 2 represents a top plate; 5 represents a looped yoke; 6 represents a loop anisotropic Nd—Fe—B system magnet; and 9 represents an outer flat yoke. An anisotropic Nd—Fe—B system magnet was used as the magnet 1 which is formed through Joule heating, and this magnet 1 is bonded integrally to an inner surface of a hollow part formed on one side of the top plate 2 through Joule heating, thereby integrating the two parts. In the outer circumference of the magnet 1 and the top plate 2, a magnetic circuit unit comprising the loop anisotropic Nd—Fe—B system magnet 6 bonded to the looped yoke 5 is positioned.

It is preferable to determine the thickness of the top plate 2 to be from 0.3 to 0.8 mm and the diameter to be from 8 to 13 mm. The thickness of the looped yoke 5 is preferably determined to be from 0.3 to 0.8 mm, the outer diameter to be from 18 to 22 mm, and the inner diameter to be from 9 to 14 mm. The thickness of the outer flat yoke 9 is preferably determined to be from 0.3 to 0.8 mm and the diameter to be from 18 to 22 mm.

Next, a method of manufacturing a magnetic circuit unit in this embodiment will be explained.

By applying the same manufacturing method shown in Example 1, the magnet 1 and the top plate 2 were integrated, and the loop anisotropic Nd—Fe—B system magnet 6 was bonded to the looped yoke 5, which is followed by adhering them on the outer flat yoke 9 in a position shown in FIG. 7. A magnetic circuit unit was manufactured in this way, and a uniform anti-corrosive coating was formed thereon.

This magnetic circuit unit was manufactured by using, for example, an integrated product comprising a columnar magnet having a diameter of 13 mm and a thickness of 1.3 mm bonded with a top plate of 13 mm in diameter and 0.8 mm thick, and by respectively adhering a product comprising a loop anisotropic Nd—Fe—B system magnet having an outer diameter of 19 mm, an inner diameter of 15 mm, and a thickness of 1.3 mm attached to a looped yoke having an outer diameter of 18 mm, an inner diameter of 14 mm, and a thickness of 0.8 mm onto an outer flat yoke formed with a diameter of 18 mm and a thickness of 0.8 mm.

Then, the columnar magnet in the above-mentioned magnetic circuit unit was magnetized in an axial direction, and after the loop anisotropic Nd—Fe—B system magnet was magnetized in a reverse axial direction, magnetic flux density in a magnetic pole gap was measured. As a result, the maximum value of the magnetic flux density was 8.7 kG, which made clear that the magnetic flux density improved by 20% versus an example which does not use a loop anisotropic Nd—Fe—B system magnet.

A magnet material used in this invention belongs to an anisotropic neodymium-iron-boron system magnet. Similarly, a magnet material which contains an additive for the improvement of temperature characteristics, such as gallium, zirconium, hafnium, and titanium, may be used. It is also possible to use an anisotropic Nd—Fe—B system magnet powder manufactured by an HDDR method (Hydrogenation-Decomposition-Desorption-Recombination method).

As clearly described in the embodiments mentioned above, it was confirmed that this invention is superior to the conventional system. In other words, according to the conventional techniques, contraction during sintering was so great in the manufacturing process of a sintered magnet, that it was difficult to obtain a small magnet with dimensional accuracy. In this case, the magnet must be ground, and the cost of grinding was comparatively higher than that for a large magnet. Therefore, as the size becomes smaller, the magnetic circuit unit becomes expensive even though the amount of magnet used is less. On the other hand, the magnet which is formed through Joule heating by passing a current under compression of this invention is formed through Joule heating inside a forming die, so that the dimensional accuracy is excellent and grinding is no longer necessary. As a result, it is advantageous in view of cost to use this magnet for a small magnetic circuit unit. Also, a detailed investigation of the manufacturing conditions proves that an integrated bonding is impossible with an ordinary sintered magnet. An adhesion only may be conducted, which is unavoidably accompanied by the problems of magnetic loss, adhesion failure, and a position gap. On the contrary, this invention enables an integrated bonding of a magnet with a top plate, an outer yoke etc.

As mentioned above, this invention provides an integrated bonding of a top plate and a magnet, so that a top plate disposed with a hollow shape can be used regardless of a shape of a bonding face. In addition, by disposing a loop anisotropic Nd—Fe—B system magnet in the outer circumference, magnetic properties can be improved. Furthermore, determining manufacturing conditions specifically enables automation of the steps of Joule heating and anti-corrosive treatment, which can contribute to a cost reduction. It goes without saying that this magnetic circuit unit is also applicable for a micromotor.

The invention may be embodied in other forms without departing from the spirit or essential characteristics thereof. The embodiments disclosed in this application are to be considered in all respects as illustrative and not as restrictive. The scope of the invention is indicated by the appended claims rather than by the foregoing description, and all changes which come within the meaning and range of equivalency of the claims are intended to be embraced therein.

What is claimed is:

1. A magnetic circuit unit for a loud-speaker, comprising:

an anisotropic Nd—Fe—B system magnet; and a top plate, being integrated with the anisotropic Nd—Fe—B system magnet on one side of the top plate, said top plate having a hollow part whose inner surface is bonded to the anisotropic Nd—Fe—B system magnet through Joule heating by passing a current under compression, an anti-corrosive coating being formed on the surface of the magnetic circuit unit.

2. The magnetic circuit unit for a loud-speaker as claimed in claim 1, wherein said hollow part of the top plate is formed in the shape of a cone.

3. The magnetic circuit unit for a loud-speaker as claimed in claim 1, wherein said hollow part of the top plate is formed in the shape of a column.

4. The magnetic circuit unit for a loud-speaker as claimed in claim 1, wherein said hollow part of the top plate is formed in the shape of a truncated cone.

5. The magnetic circuit unit for a loud-speaker as claimed in claim 1, wherein said hollow part of the top plate is formed in the shape of a partial sphere.

6. The magnetic circuit unit for a loud-speaker as claimed in claim 1, wherein the anti-corrosive coating comprises an acrylic resin anti-corrosive coating with a thickness of 7 to 15 μm.

7. A magnetic circuit unit for a loud-speaker, comprising:

an anisotropic Nd—Fe—B system magnet; and a top plate, being integrated with the anisotropic Nd—Fe—B system magnet on one side of the top plate, said top plate having a hollow part whose inner surface is bonded to the anisotropic Nd—Fe—B system magnet through Joule heating by passing a current under compression, a magnetic circuit member which is bonded to a loop anisotropic magnet at a looped yoke being disposed at an outer circumference of the magnetic circuit unit, an anti-corrosive coating being formed on the surface of the magnetic circuit unit.

8. The magnetic circuit unit for a loud-speaker as claimed in claim 7, wherein said hollow part of the top plate is formed in the shape of a cone.

9. The magnetic circuit unit for a loud-speaker as claimed in claim 7, wherein said hollow part of the top plate is formed in the shape of a column.

10. The magnetic circuit unit for a loud-speaker as claimed in claim 7, wherein said hollow part of the top plate is formed in the shape of a truncated cone.

11. The magnetic circuit unit for a loud-speaker as claimed in claim 7, wherein said hollow part of the top plate is formed in the shape of a partial sphere.

12. The magnetic circuit unit for a loud-speaker as claimed in claim 7, wherein the anti-corrosive coating comprises an acrylic resin anti-corrosive coating with a thickness of 7 to 15 μm.

13. A loud-speaker comprising a magnetic circuit unit as claimed in claim 1.

14. A loud-speaker comprising a magnetic circuit unit as claimed in claim 7.

15. The magnetic circuit unit for a loud-speaker as claimed in claim 1, wherein the top plate is aligned with and has a diameter equal to the outer diameter of the anisotropic Nd—Fe—B system magnet.

16. The magnetic circuit unit for a loud-speaker as claimed in claim 7, wherein the top plate is aligned with and has a diameter equal to the outer diameter of the anisotropic Nd—Fe—B system magnet.

* * * * *